US006520243B1

(12) United States Patent
Dugger

(10) Patent No.: US 6,520,243 B1
(45) Date of Patent: Feb. 18, 2003

(54) MOLD RIDING SHOT BLOCKER

(75) Inventor: Ben A. Dugger, Pell City, AL (US)

(73) Assignee: Vulcan Engineering Company, Inc., Helena, AL (US)

( * ) Notice: Subject to any disclaimer, the term of this patent is extended or adjusted under 35 U.S.C. 154(b) by 0 days.

(21) Appl. No.: 09/758,053

(22) Filed: Jan. 10, 2001

(51) Int. Cl.[7] ..... B22D 35/04; B22D 37/00
(52) U.S. Cl. ..... 164/130; 164/136; 164/323
(58) Field of Search ..... 164/130, 133, 164/136, 322–331, 335–337, 167, 168

(56) References Cited

U.S. PATENT DOCUMENTS 4,576,217 A 3/1986 Shaw
4,749,019 A 6/1988 Sorrell et al.
4,966,222 A 10/1990 Paton et al.
5,879,721 A 3/1999 Bradley
5,971,059 A 10/1999 Hunter et al.

*Primary Examiner*—Kuang Y. Lin
(74) *Attorney, Agent, or Firm*—Smith, Gambrell & Russell, LLP

(57) ABSTRACT

The mold riding shot blocker comprises an apparatus and method for blocking the spillage of molten metal between adjacent molds in a conveyable string of closely juxtaposed molds as the mold string is advanced in a stepwise cycle in a metal casting process. The invention comprises a solid object having a configuration suitable for placement on the top surface of a mold string to cover at least one downsprue extending from the top surface, and a means for lowering the solid object onto the top surface of a mold string to cover at least one downsprue and raising the solid object from the top surface to uncover at least one downsprue. The method comprises the steps of positioning a solid object for placement on the top surface of a mold string, lowering the solid object into a protective position on a top surface of the mold and indexing the conveyable mold string with the solid object riding on the mold string in a protective position covering at least one downsprue.

21 Claims, 7 Drawing Sheets

MOLD RIDING SHOT BLOCKER

FIELD OF THE INVENTION

The present invention relates to the field of foundry operations and more particularly to the casting of molten metal in a production line environment. In greater particularity the present invention relates to a technique for casting molten metal in a production process utilizing a conveyable string of molds that define a series of mold cavities. In still further particularity, the present invention relates to an apparatus and method for preventing the premature introduction of molten metal into a mold cavity formed by a conveyable string of molds as the mold string is advanced stepwise along a conveying system in a metal casting process.

BACKGROUND OF THE INVENTION

The art of casting metal objects in sand molds is ancient. Numerous advances have been made in the art, and metal casting may now be accomplished by complex, automated production techniques utilizing a conveyable string of closely juxtaposed molds that are advanced along a production line. A mold string used in well known production casting systems typically comprises multiple adjacent molds, each distinct mold defining a mold cavity and at least one passageway, referred to as a downsprue, leading from the mold cavity to a surface of the mold. In the production method, castings are formed by introducing molten metal into the downsprue of a mold to fill the mold cavity and thereafter allowing the molten metal to cool to form a solid casting. Economic constraints require increasing efficiency in the casting process, and it is well known in the art that it is desirable that individual castings be formed in relatively short time intervals without having an adverse impact on the quality of the metal casting.

Metal casting production techniques utilizing a conveyable mold string require a source of molten metal and a method of transferring selective quantities of molten metal from a molten metal source to individual molds. In the production line casting of molten metal, molten metal is typically provided in batches stored in a large reservoir or ladle. An efficient and commonly used method of transferring molten metal into individual molds from the source of molten metal is to pour molten metal from a source into the downsprue of a mold. Utilization of this method of transferring requires positioning the source of molten metal, such as a reservoir or ladle, above the mold string.

A common method of pouring molten metal from a molten metal reservoir is to selectively open and close an outlet located in the bottom portion of a molten metal reservoir, such as with the use of a stopper rod positioned within the reservoir that can be raised to open the outlet and lowered to close the outlet. This method of transferring molten metal into individual molds often involves aligning the downsprue of an individual mold directly below the effluent outlet of a molten metal reservoir for the receipt of the molten metal poured from the reservoir outlet.

Production methods of the type utilizing a source of molten metal disposed directly above a conveyable mold string typically utilize a specific type of mold string having downsprues extending from the top surface of the mold string. In the casting process, the mold string of this type is indexed to position a first individual mold beneath the molten metal source so that the downsprue in the top surface of the mold string is aligned directly below the outlet. In a typical production casting process, the mold string remains in a stationary position as the outlet is opened to fill the mold with molten metal. After the selected amount of molten metal has been poured into the mold, the outlet is closed to cease the transfer of molten metal. The mold string is then indexed, or advanced, along a conveying system to a next stationary position in which a next mold being adjacent to the first individual mold is aligned directly beneath the outlet of the molten metal source. This next mold is then filled with molten metal and this process is repeated in sequence to progressively fill adjacent molds with molten metal.

Various techniques for producing a mold string defining a series of mold cavities and downsprues extending from the top surface of the mold string are commercially available and widely utilized. A mold string of this general type may be manufactured in connection with metal casting in vertically-parted green sand molds, and in connection with molds produced utilizing the well known Disamatic machine. Other similar methods of such production of mold strings are well known in the art.

Without regard to the specific manner in which a particular mold string is produced, mold strings typically utilized in production line casting techniques comprise a series of vertically parted molds wherein each mold defines a mold cavity and a downsprue extending from the top surface of the mold string. There is a continual problem relating to the use of vertically parted molds such as those produced by a Disamatic molding machine and other common production techniques. Such molds are in relatively close proximity to adjacent molds, and in actual operation molten metal intended for introduction into specific mold cavities may instead be ultimately deposited on the top surface of a mold string. This can result in the unintended and premature introduction of molten metal into an empty mold cavity, which causes serious defects in the resulting quality of produced castings. Molten metal prematurely introduced into an empty mold cavity cools to form small droplets of metal commonly referred to as "shots." The casting process is typically not designed for the random and unintended introduction of shots into an empty mold cavity prior to filling the mold cavity with molten metal. Instead, the casting process is designed to fill mold cavities that are entirely empty. This allows the molten metal introduced into the mold cavity to have substantially uniform metallurgical properties.

The premature introduction of shots into an empty mold cavity can result in the production of castings having significant defects. The shot produces an inclusion in the casting causing scrap or, worse, resulting in the failure of a safety part. The molten metal poured into the mold may not adhere properly to the shot or the shot may otherwise adversely influence the cooling properties of the molten metal proximate the shot. The premature introduction of even small droplets of molten metal forming shot into an empty mold cavity results in serious defects in the quality of produced castings. Therefore, methods of preventing the premature introduction of shot into molds in a casting process is needed.

One manner in which this quality control problem initially occurs is by the splashing of molten metal from one mold to an adjacent mold during pouring of molten metal. Methods of preventing this type of manufacturing problem are disclosed in the prior art. Sorrell et al., U.S. Pat. No. 4,749,019 discloses the utilization of a splash guard in a metal casting process for preventing molten metal from splashing into the downsprue of a mold as molten metal is poured into an adjacent mold cavity. The Sorrell et al. device is a solid object that is selectively placed between adjacent molds during the pouring of molten metal. In a manual casting process, a portion of the Sorrell et al. device physically contacts a portion of the top surface of the mold string and remains in this position as molten metal is poured. After molten metal has been poured into a cavity, the splash guard disclosed in the Sorrell et al. patent is then raised from the top surface of the mold string. The Sorrell et al. device remains in a raised position as the mold string is indexed to the next position.

A second embodiment of the device disclosed in the Sorrell et al. patent is directed for use in an automated production process. In the second embodiment, the splash guard remains in a fixed raised position above the top surface of the mold string. These and other conventional methods of preventing the premature introduction of molten metal into an empty mold cavity address the problem of the spillage of molten metal between adjacent molds during pouring of molten metal.

A significant limitation in the conventional methods of preventing the introduction of shot into an empty mold is that these methods do not address the continual problem of the spillage of molten iron between adjacent molds occurring as a result of the movement of the mold string during the production process. For example, the previously discussed Sorrell et al. device is placed in a raised position off the surface of a mold string as the mold string is indexed. Thus, the Sorrell et al. device does not prevent the introduction of molten metal into a downsprue when the mold string is in motion.

The metal casting process industry is highly competitive, and to address competitive pressures it is generally desirable to improve the efficiency of the production process. A readily apparent method to do so is increasing the speed at which the mold string is advanced during the production process, so that individual castings may be formed in a relatively short time frame. Increasing the indexing speed requires reducing the period of time that a mold string is moved from an initial stationary position to a second stationary position. By necessity, it can be appreciated that increasing the overall indexing speed requires a higher rate of acceleration from which a mold string is moved from an initial stationary position. Thus, generally, as metal casting processes become increasingly more efficient, mold strings are generally indexed at increasingly higher speeds.

The problem not addressed in conventional methods of casting results from the presence of molten metal on the top surface of a mold cavity as the mold string is advanced in a casting production process. As is well known in the art, a mold string for use in a casting process commonly defines a substantially continuous top surface between adjacent downsprues. Although unintended, during the operation of a production casting method, molten metal may be spilled, splashed, or overflowed onto the top surface of the mold string during the pouring or indexing steps. The acceleration of a mold string from a stationary position causes, which can be abrupt, causes movement of spilled molten metal across the substantially continuous top surface of the mold string, often resulting in the premature introduction of molten metal into an empty mold cavity.

Whether caused by the splashing of molten metal during the pouring process or by the movement of the mold string, quality control problems resulting from the premature introduction of molten metal into an empty mold cavity in a casting process are equally serious. To address the limitations of the prior art and to improve the quality and efficiency of metal castings, what is needed is an apparatus and method for preventing the premature introduction of molten metal into a mold cavity formed by a conveyable string of molds as the mold string is advanced stepwise along a conveying system in a metal casting process.

SUMMARY OF THE INVENTION

It is an object of the present invention to provide an improved method of casting metal.

An additional object of the present invention is to provide an apparatus and method for improving the quality of metal castings produced in the production line casting of molten metal.

A further object of the present invention is to prevent defects in castings produced in the production line casting of molten metal resulting from the spillage of molten metal between adjacent molds in a conveyable string of closely juxtaposed molds.

An additional object of the present invention is to provide an apparatus and method for preventing the inadvertent and premature introduction of molten metal into a mold cavity formed by a conveyable string of molds as the mold string is indexed in a metal casting process.

A still further object of the present invention is to provide an apparatus and method for preventing the premature introduction of molten metal into a mold cavity that may be adapted for use in casting processes that are both manually and automatically operated.

These and other objects of the invention are provided by a mold riding shot blocker designed for use with prior well known production casting systems utilizing conveyable mold strings comprising closely juxtaposed molds that define a substantially continuous top surface, a series of mold cavities, and a series of downsprues extending from said mold cavities to the top surface. The mold riding shot blocker of the present invention comprises a solid object having a configuration suitable for placement on the top surface of a mold string so that when the solid object is placed on the top surface of a mold string, at least one downsprue extending from the top surface of the mold string is covered. Being at rest on the top surface of the mold string, the solid object provides a barrier that prevents the premature introduction of molten iron into any downsprue covered by the solid object. Although the preferred embodiment discloses a solid object being a blocking bar having a rectangular configuration and a substantially flat top and bottom surfaces, solid objects having other configurations suitable for placement on a mold string to cover at least one downsprue are contemplated. The invention further comprises a means for lowering the solid object onto the top surface of a mold string and raising the solid object off the top surface of a mold string to cover and uncover at least one downsprue during movement of the mold string along a conveying system in a metal casting process.

The present invention further comprises a method for blocking the spillage of molten metal between adjacent molds in a conveyable string of closely juxtaposed molds as the mold string is advanced in a stepwise cycle in a metal casting process. The method is directed for use with a mold string comprised of molds that define a top mold surface, a casting cavity, and at least one mold inlet extending from the casting cavity to the top mold surface. The method comprises the steps of positioning a solid object having a configuration suitable for placement on the top surface of a mold string, lowering the solid object into protective position on a top surface of a first mold with the mold string in a stationary first position to cover at least one mold inlet of the first mold. The method of the present invention further comprises the step of indexing the conveyable mold string with the blocking bar riding on the mold string in a protective position during at least a portion of a stepwise cycle comprising the movement of the conveyable mold string from a stationary first position to a stationary second position. The method also comprises the step of raising the solid object away from the top surface of the first mold to uncover at least one mold inlet.

The apparatus and method of the present invention thus overcomes the limitations of the prior art by preventing the inadvertent premature introduction of molten metal, or shot, into an empty mold cavity of a mold string as the mold string is advanced stepwise in a casting production process. The mold riding shot blocker is placed on the top surface of mold string to cover at least one downsprue. With a downsprue covered, an adjacent mold is filled with molten metal. Upon completion of filling an adjacent mold with molten metal, the mold string may be indexed with the mold riding shot blocker remaining in a protective position on the mold string. During the period of time the mold riding shot blocker remains in a protective position atop the mold string, the mold riding shot blocker provides a barrier for introduction of molten metal into the covered downsprue. Thus the present invention overcomes the limitations of the prior art by providing a barrier for the covered downsprue not only during the filling of an adjacent mold with molten metal but also during indexing of the mold string along the production process.

Although the present invention may be manually operated, the present invention further comprises a control means such as a micro-processor for automating the process of selectively raising and lowering the mold riding shot blocker to coordinate the operation of the invention with a highly automated casting production process. Specifically, the raising and lowering of the present invention can be automatically coordinated with the indexing of the mold string and the pouring of molten metal into successive mold cavities.

BRIEF DESCRIPTION OF THE DRAWINGS

An apparatus embodying the features of my invention are depicted in the accompanying drawings which form a portion of this disclosure and wherein.

DESCRIPTION OF THE PREFERRED EMBODIMENT

Figure 1:
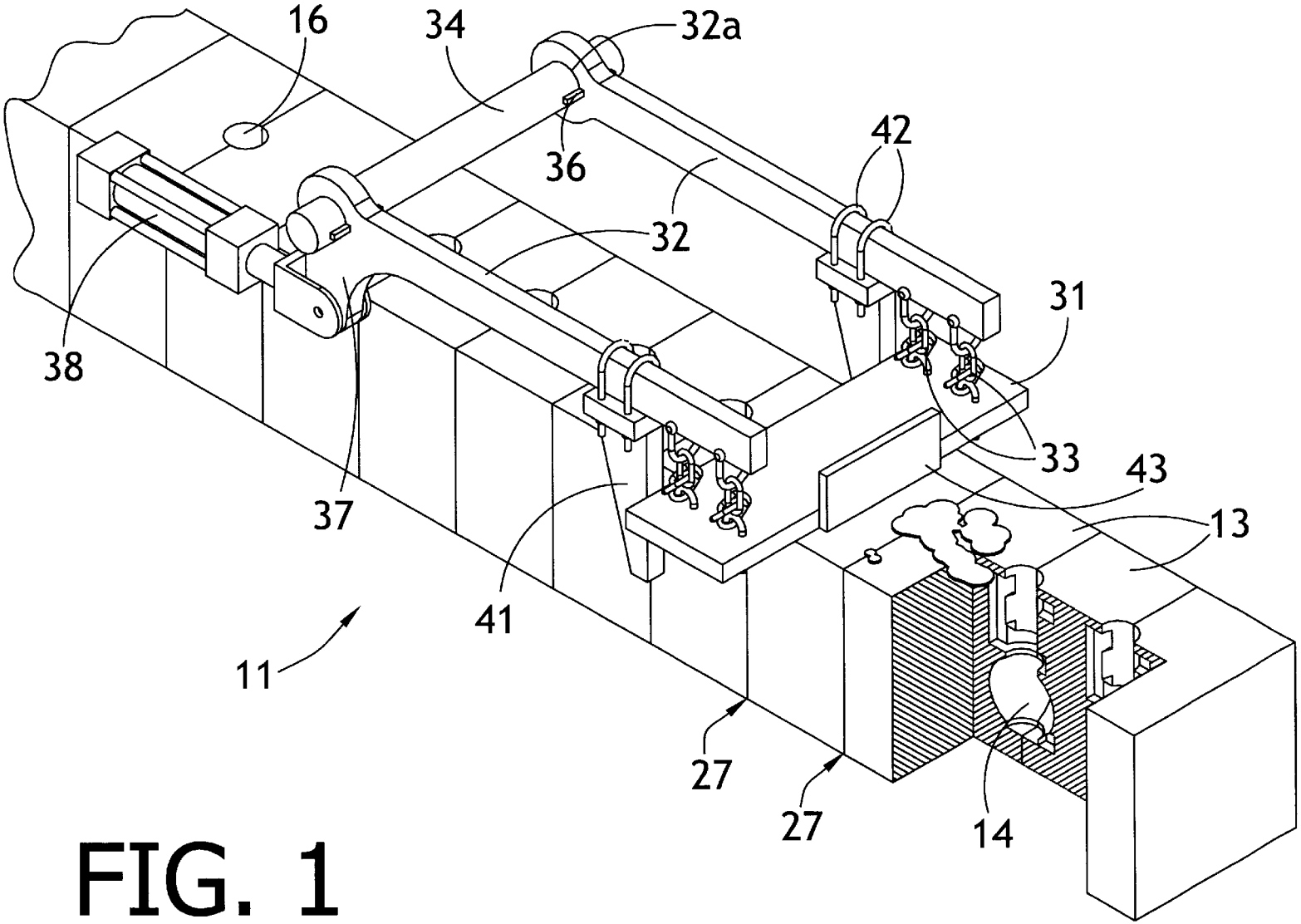
FIG. 1 is a perspective view of the mold riding shot blocker.
Figure 2:
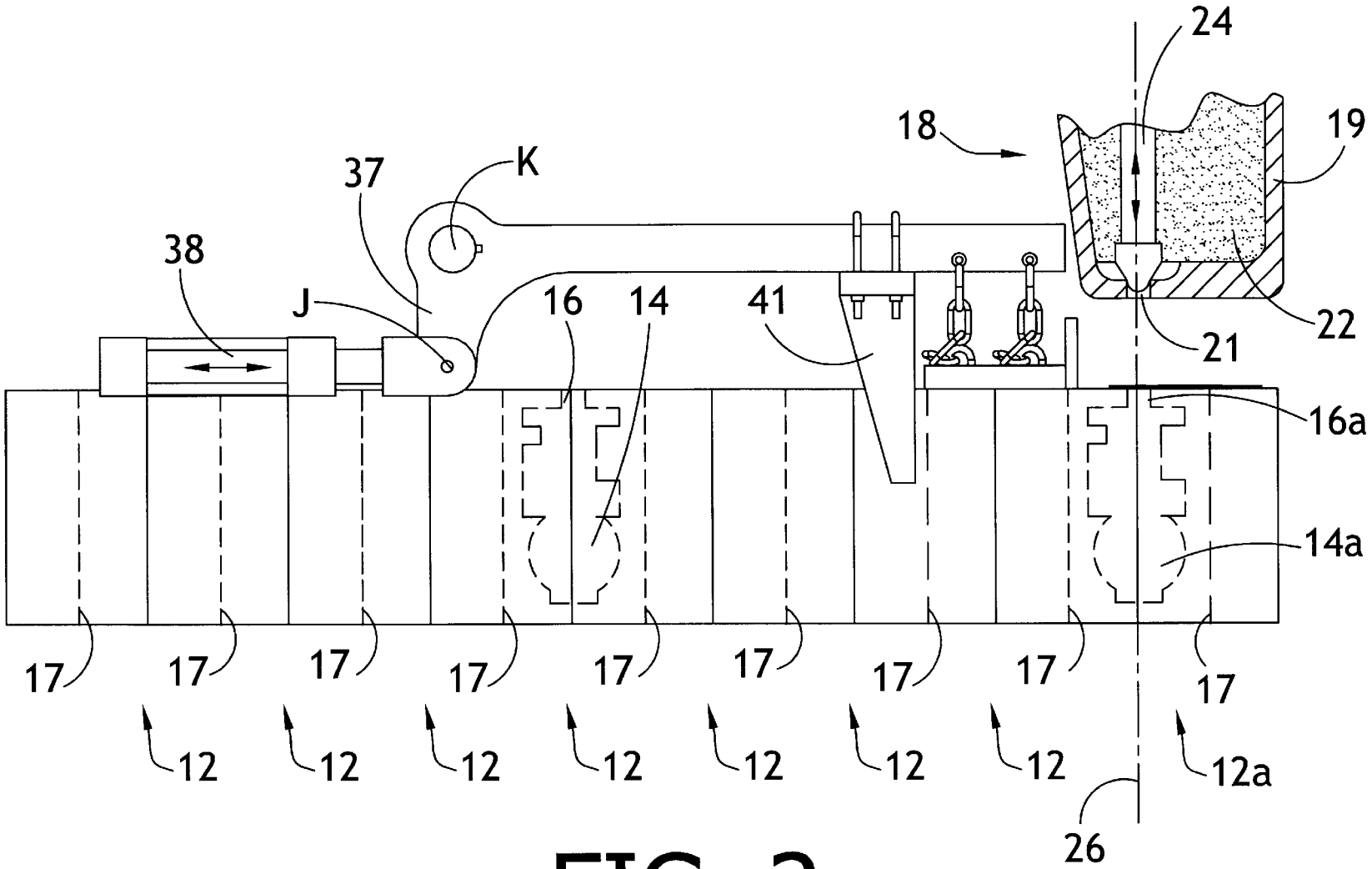
FIG. 2 is a side elevational view of the mold riding shot blocker.

Referring to the drawings for a clearer understanding of the invention it will be seen in FIGS. 1 and 2 that the present invention is an apparatus for blocking the spillage of molten metal between adjacent molds in a metal casting process having a conveyable string of molds 11. The mold string 11 is comprised of a series of closely juxtaposed molds 12 that define a substantially continuous top surface 13, a series of mold cavities 14, and a series of downsprues 16 extending from the mold cavities 14 to the top surface 13 of the mold string. The front surface of each successive mold 12 in the mold string 11 abuts the rear surface of an adjacent mold along a line of abutment 17 such that each mold 12 defines a complete mold cavity 14 and downsprue 16 as shown on FIGS. 2 and 3.

The preferred embodiment of the present invention is utilized in a metal casting process having a source of molten metal 18 located above the mold string 11. A configuration of a typical casting process for use with the present invention is shown in FIG. 2, wherein a source of molten metal 18 comprising a molten metal reservoir 19 having an effluent outlet 21 for directing molten metal 22 into a mold cavity 14 is positioned above the top surface 13 of the mold string. The source of molten metal 18 further comprises a means for controlling the flow of molten metal 22 from the effluent outlet 21 being a stopper rod 24. Raising the stopper rod 24 opens the effluent outlet 21, establishing the flow of molten metal 22 therethrough, and lowering the stopper rod 24 closes the effluent outlet 21, ceasing the flow of molten metal 22 from the molten metal reservoir 19.

The mold string 11 is advanced, or indexed, along a conveying system so that an empty mold cavity and associated downsprue are aligned directly below the source of molten metal. A downsprue 16A and mold cavity 14A aligned below the effluent outlet 21 is shown on FIG. 2 as a mold having a downsprue centered about a vertical line 26 passing through the effluent outlet 21. After the mold string 11 has been indexed, the mold string 11 is maintained in a stationary position as molten metal is released from the molten metal reservoir 19 through the effluent outlet 21. In this step of the casting process, molten metal 22 pours into the downsprue 16A of the aligned mold 12A. After the aligned mold cavity 14A and downsprue 16A have been selectively filled with molten metal 22, the flow of molten metal 22 from the molten metal reservoir 19 into the aligned mold 12A is stopped. After an aligned mold as shown in FIG. 2 is filled with molten metal 22, the mold string 11 is then moved from its stationary aligned position and advanced along the conveyor to a next stationary position wherein an empty mold adjacent the full mold 12A is positioned below the effluent outlet 21. The previously described pouring and indexing steps are repeated in a stepwise fashion. In this manner, mold cavities 14 are sequentially filled with molten metal to form metal castings.

The present invention is designed for use in various metal casting processes utilizing a conveyable mold string having downsprues extending from the top surface of the mold string. One general type of casting process in which the present invention may be employed include processes utilizing the Disamatic machine to produce a mold string. As is well known in the art, molds produced by a Disamatic machine have a centrally located vertical parting line, shown in FIGS. 1–6 as lines 27. FIGS. 1–6 display the preferred embodiment of the present invention utilized with a specific type of mold string (i.e., a mold string having vertically-parted molds manufactured by a Disamatic machine) and a specific type of molten metal source (i.e., a molten metal reservoir and means for dispensing molten metal having a specific configuration). The depiction of specific components of a metal casting process for use with the preferred embodiment of the present invention is not intended to limit the scope of the present invention. The present invention may be utilized with any conveyable series of molds having a top surface and at least one downsprue extending from the top surface.

The preferred embodiment of the present invention is an apparatus comprising a rectangular flat blocking bar 31 having substantially flat top and bottom surfaces. As shown on FIG. 3, the length D of the blocking bar 31 is greater than the downsprue width A so that when the blocking bar 31 rests on the top surface 13 of the mold string, the blocking bar 31 may be positioned to entirely cover at least one downsprue 16. The width E of the blocking bar 31 in the preferred embodiment is greater than the width B of the mold string 11.

The blocking bar 31 is comprised of a heat resistant solid material that maintains its structural integrity in high-temperature manufacturing processes. The blocking bar 31 also preferably has an outer surface to which molten metal does not readily adhere upon contact. In the preferred embodiment the blocking bar 31 is comprised of graphite, which has a high structural strength and a high melting point. Because of the high-temperature industrial environment in which the present invention operates, all of the components of the present invention must be solid materials having sufficient heat-resistant properties.

The preferred embodiment further comprises a bar shield 43 fixedly attached to the forward facing surface of the blocking bar 31. The bar shield 43 is positioned at the location of the blocking bar 31 that contacts molten metal sloshing across the top surface 13 of the mold string as it is accelerated along a conveying system in a casting process. Molten metal moving across the top surface 13 would contact the forward face of the bar shield 43, so the bar shield 43 is preferable comprised of a solid material having heat-resistant properties superior to the blocking bar 31. The use of a bar shield 43 assists in maintaining the structural integrity of the blocking bar 31 as the present invention is repeatedly used to block the premature introduction of molten metal into selected mold cavities.

As shown in FIG. 1, the blocking bar 31 is placed on the top surface 13 of the mold string 11 so that at least one downsprue 16 is covered. With the bottom surface of the blocking bar 31 resting on the mold string 11, the blocking bar 31 provides a barrier for entry of molten metal from prematurely entering the covered downsprue 16 during the casting process. In the present invention, the blocking bar 31 remains at rest on the surface 13 of the mold string 11 as the mold string 11 is advanced stepwise in the casting process. Thus, the blocking bar 31 remains in a protective position, preventing the premature introduction of molten metal into the covered downsprue 16, as the covered downsprue 16 is accelerated along a conveyor from a rest position. This addresses the continual problem encountered in casting using a conveyable mold string having downsprues extending from the top surface of the mold string, of spillage of excess molten iron from the top of a mold that has been filled with molten iron to the adjacent, or next, downsprue as the mold string is advanced in the casting process. The blocking bar 31 is placed on the mold string 11 to cover a downsprue 16 and is allowed to ride the mold string 11 as it is accelerated along the conveying system. It can be appreciated from a review of FIGS. 1–6 that with the blocking bar 31 resting on the mold string 11, the blocking bar 31 prevents the entry of foreign matter into the covered downsprue 16. This includes protection against the premature entry of any molten metal that sloshes across the substantially continuous top surface 13 of the mold string 11 as mold string is indexed. The blocking bar 31 literally rides the mold string 11 as it is advanced stepwise in a metal casting process and literally blocks the premature introduction of shot into the mold cavity 14 of a covered downsprue 16. The mold riding shot blocker of the present invention significantly improves the quality of metal casting and represents an improvement in the metal casting process.

The present invention provides for the placement of a blocking bar 31 in a rest position on the top surface 13 of a mold string 11 in a metal casting process, and allowing the blocking bar 31 to rest on the mold string 11, or ride the mold string 11, as it is advanced in a metal casting process. The blocking bar 31 is utilized to cover a downsprue 16 before it is filled with molten iron, to maintain the integrity of the associated mold cavity 14 before it is used to form a metal casting. As is apparent from the nature of the invention, at some point in the casting process the blocking bar 31 must be raised from the top surface 13 of the mold string 11 to uncover the protected downsprue 16 to allow for the introduction of molten metal. Thus, it can be appreciated that in addition to a blocking bar 31, the present invention also has a means for selectively raising and lowering the blocking bar 31 from the top surface 13 of the mold string 11.

Although the preferred embodiment shows a blocking bar 31 having a specific rectangular configuration, blocking bars having other shapes are also suited for placement on the surface of a mold string to cover at least one downsprue and to ride the mold string as it is advanced in a casting process. Thus, the present invention may utilize blocking bars having various configurations not shown in the preferred embodiment. It can be appreciated from the nature of the invention that the blocking bar 31 may be embodied by alternate shapes. Similarly, the preferred embodiment includes a specific means for selectively raising and lowering the blocking bar 31 from the top surface 13 of a mold string 11, and allowing the blocking bar 31 to ride the mold string 11. It is contemplated that other means for raising and lowering the blocking bar 31, and allowing the blocking bar 31 to ride the mold string 11 are equally suited for use with the invention. It can be appreciated from the nature of the invention that the means for raising and lifting the blocking bar 31 may be embodied by alternate configurations.

As shown in FIG. 1, in the preferred embodiment the means for placing the blocking bar 31 in a rest position on the top surface 13 of the mold string 11 to cover at least one downsprue 16 and the means for lifting and raising the blocking bar 31 comprises a pair of lift arms 32 having a proximal end and a distal end positioned above the blocking bar 31. Fixedly attached to the distal end of the pair of lift arms 32 are a plurality of chains 33. One end of the chains 33 is attached to the lower surface of the lift arms utilizing conventional methods of connection that are well known in the art. The other ends of the chains 33 are connected to the top surface of the blocking bar 31. The chains 33 are generally of the same length to allow a blocking bar 31 hanging from the lift arms 32 by the chains 33 to be maintained in a generally horizontal position above the mold string 11. The predetermined lengths of the chains 33 are selected to allow the blocking bar 31 to hang freely below the lift arms 32 when the lift arms 32 are in a raised position and to allow the blocking bar 31 to rest on the top surface 13 of the mold string 11 when the lift arms 32 are in a lowered position. Although other lengths of chains 33 are contemplated, in the preferred embodiment the chains 33 are of sufficient minimum length to allow the blocking bar 31 to ride on the mold string 11 for a distance of at least three-quarters of the approximate distance C between adjacent downsprues. Although the preferred embodiment has a plurality of chains 33 connecting the pair of lift arms 32 to the blocking bar 31, other inextensible flexible links such as, but not limited to, wire may also be used as a means for connecting the blocking bar 31 and lift arms 32.

The chains 33 and the slack in the chains 33 provides a means for maintaining the blocking bar 31 in a rest position on the mold string 11 during movement of the mold string 11 along a conveying system in a metal casting process provide. In conjunction with the lift arms 32, the chains 33 also provide a means for lifting the blocking bar 31 from a rest position to uncover said downsprue 16. When the blocking bar 31 is initially placed on the mold string 11, there is slack in the chains 33 that allows the blocking bar 31 to remain in a resting position on top of the mold string 11 as it is advanced for a distance approximately equal to at least as long as the length of the slack in the chains 33. Raising the lift arms 32 removes slack from the chains 33 and causes the blocking bar 31 to be raised from the mold string 11.

In the preferred embodiment, a cylindrical connecting rod 34 having two ends and a longitudinal axis is fixedly attached at its ends to the proximal ends of the lift arms 32. The means for connecting the lift arms 32 to connecting rod are cylindrical apertures 32A in the proximal ends of the lift arms that slidably engage the cylindrical rod 34. A pair of keyways 36 formed in the connecting rod 34 engage a pair of seats proximate the lift arm apertures 32A to prevent the lift arms 32 from rotating around the cylindrical connecting rod 34. When the lift arms 32 are in a lowered position wherein the blocking bar 31 rests on the mold string 11, the lift arms 32 are in a horizontal position with the longitudinal axis of the lift arms 32 generally parallel with one another and with the longitudinal axis 32 of the mold string 11. The connecting rod 34 is maintained in a horizontal position above the mold string 11 with its longitudinal axis generally perpendicular to the longitudinal axis 15 of the mold string 11.

Although not shown in FIGS. 1–6, conventional means well known in the art are employed for pivotally mounting the connecting rod 34 so that it can rotate about the longitudinal axis of the connecting rod 34, shown as pivot point K on FIG. 2. With the connecting rod 34 pivotally mounted about its longitudinal axis, a means for pivoting the connecting rod 34 about pivot point K provides the means for raising the lift arms 32 to remove the blocking bar 31 from the mold string 11 and for lowering the lift arms 32 to place the blocking bar on the mold string 11.

In the preferred embodiment, as shown on FIG. 1, the means for pivoting the connecting rod 34 comprises an extension portion 37 of one of the pair of lift arms 32, the extension portion extending directly below the connecting rod 34, a linear hydraulic control rod 38 horizontally mounted proximate the extension portion 37, and a means for pivotally connecting an end of the control rod 38 to the extension portion 37. The control rod 38 is a positioning device that may comprise a hydraulic cylinder, gas cylinder, or mechanical powerscrew or similar devices known to those skilled in the art. The control rod 38 provides a power actuated means for raising and lowering the lift arms 32 and thus positioning the lift arms as desired.

With reference to FIG. 2, the linear movement of the control rod 38 causes the concomitant pivotal movement of the extension portion 37 about pivot point J and the pivotal movement of the lifts arms 32 about the connecting rod 34 at pivot point K. The forward linear movement of the control rod 38 causes the lift arms 32 to raise and the rearward linear movement of the control rod 38 causes the lift arms 32 to lower. The linear movement of the control rod 38 thus provides a means for controlling the raised or lowered position of the lift arms 32.

Figure 3:
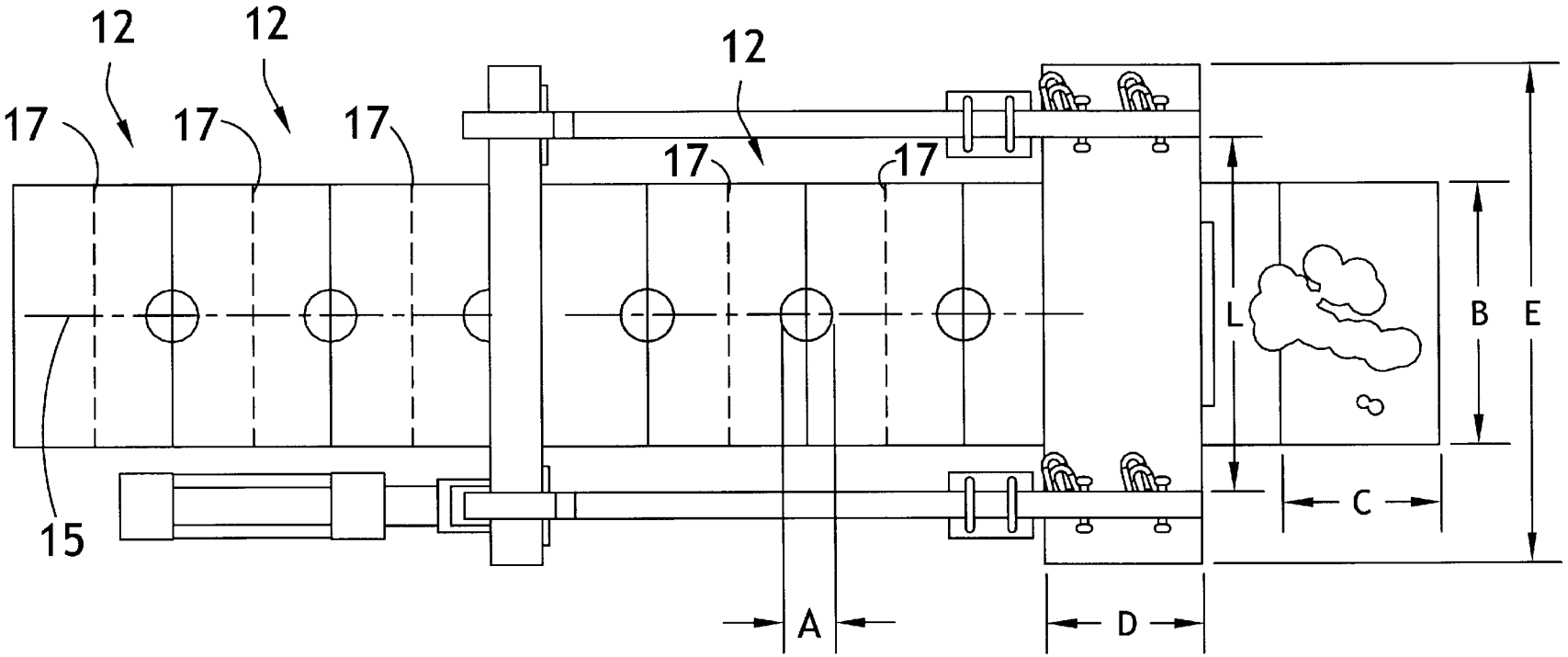
FIG. 3 is a top plan view of the mold riding shot blocker.

In the preferred embodiment, as shown on FIG. 3, the distance L between the lift arms 32 is greater than the width B of the molds. Fixedly attached to the bottom surface of the lift arms 32 and extending directly below the lift arms 32 is a pair of stops 41 having a substantially flat forward surface generally facing the distal end of the lift arms 32 when the lift arms 32 are in a lowered position. As shown in FIGS. 1 and 2, the distance between the stops 41 is greater than the width B of the molds. When the lift arms 32 are in a lowered position, the stops 41 are positioned on opposite sides of the mold string 11 with the bottom edges of the stops 41 extending below a plane defined by the top surface 13 of the mold string. When the lift arms 32 are raised, the blocking bar 31 hangs from the lift arms 32 with at least a portion of the rear surface of the blocking bar 31 in conforming contact with at least a portion of the forward surface of the stops 41. As the lift arms 32 are lowered, the stops 41 provide a guide for the placement of the blocking bar 31 in a selective location on the mold string 11. As the mold string 11 is advanced in the casting process, the blocking bar 31 rides on the top surface of the mold string 11 away from the forward edge of the stops 41.

Figure 4:
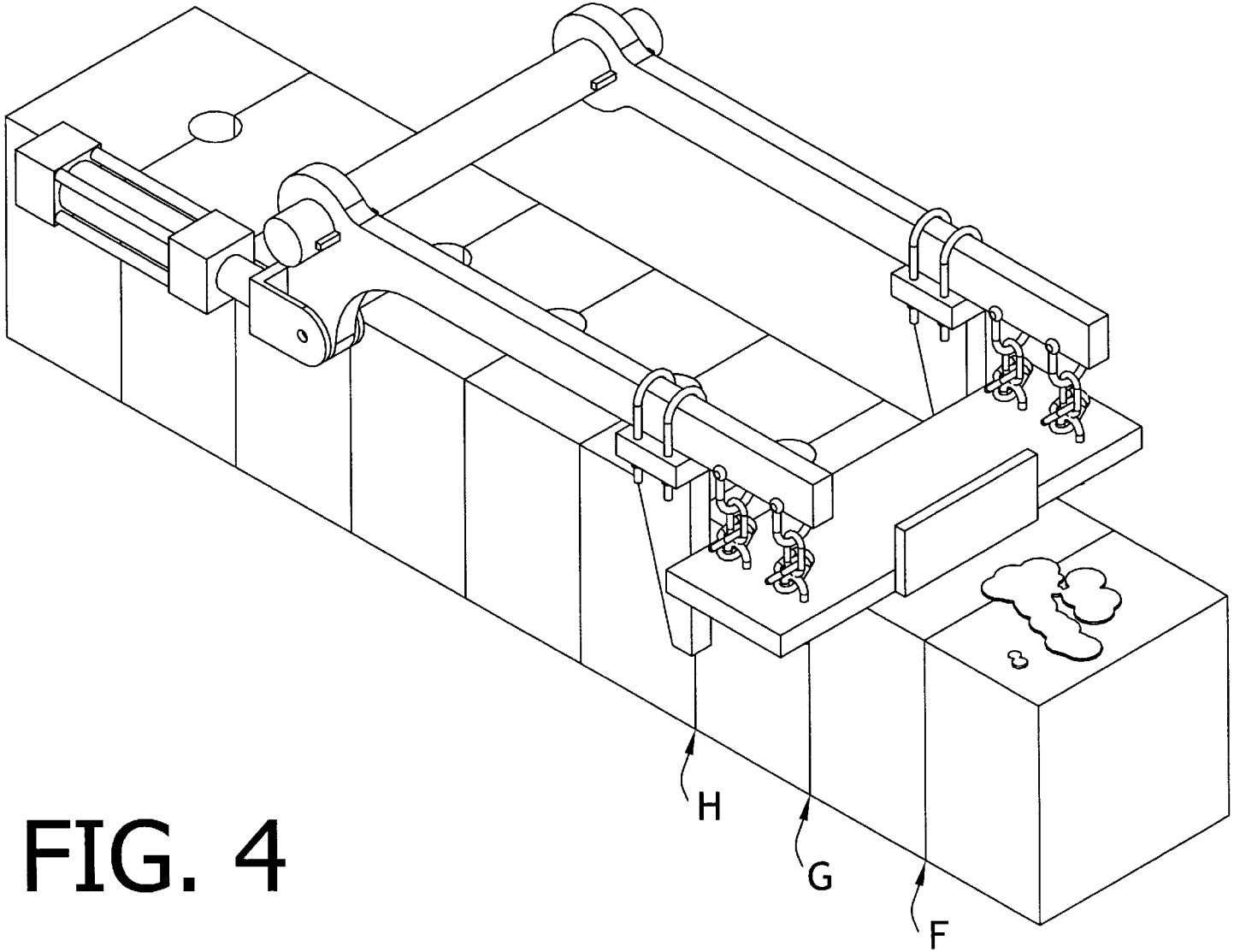
FIG. 4 is a perspective view of the mold riding shot blocker showing the device in a lowered initial position prior to the indexing of the mold string.
Figure 5:
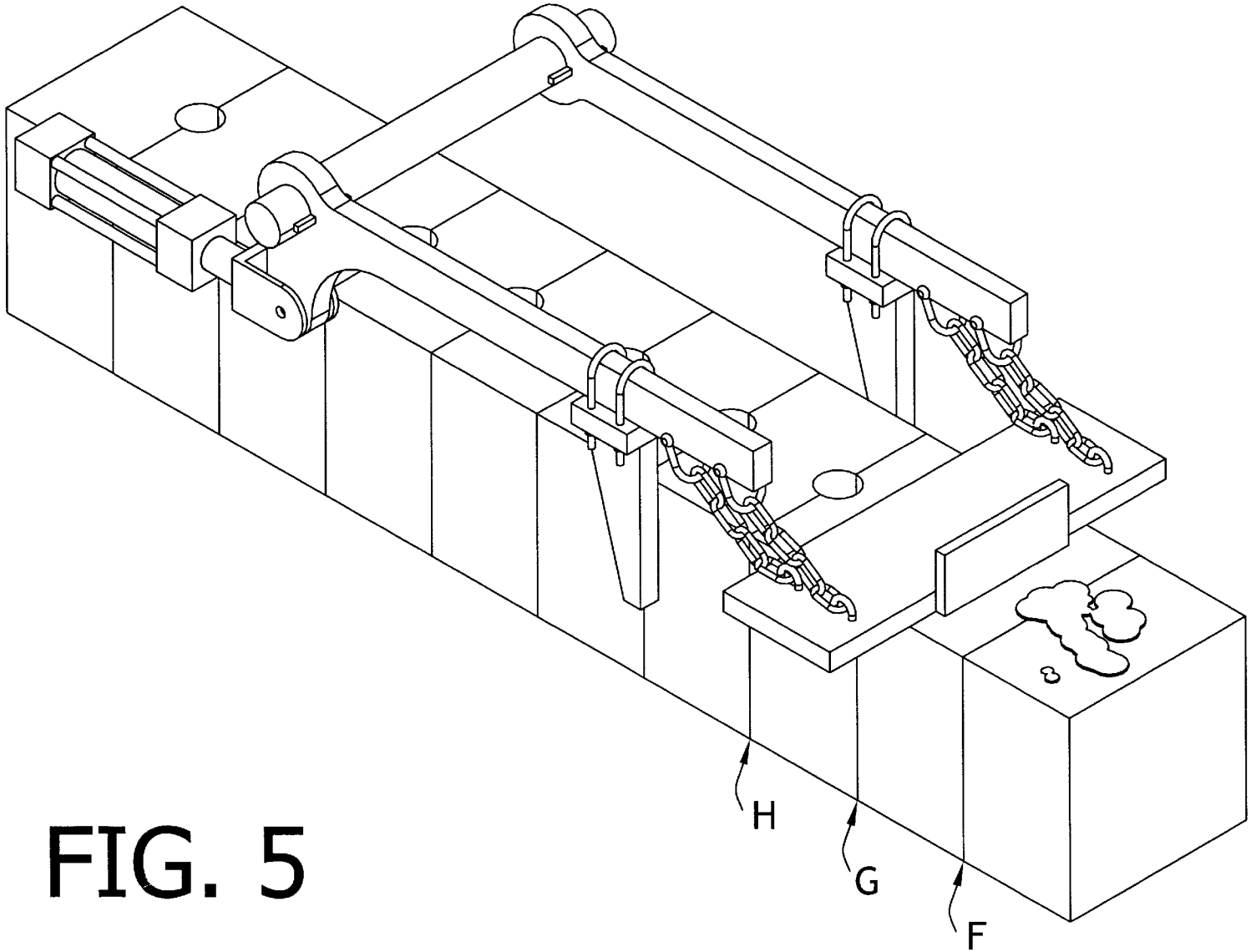
FIG. 5 is a perspective view of the mold riding shot blocker showing the device in a lowered position after indexing of the mold string through at least a portion of an indexing cycle.
Figure 6:
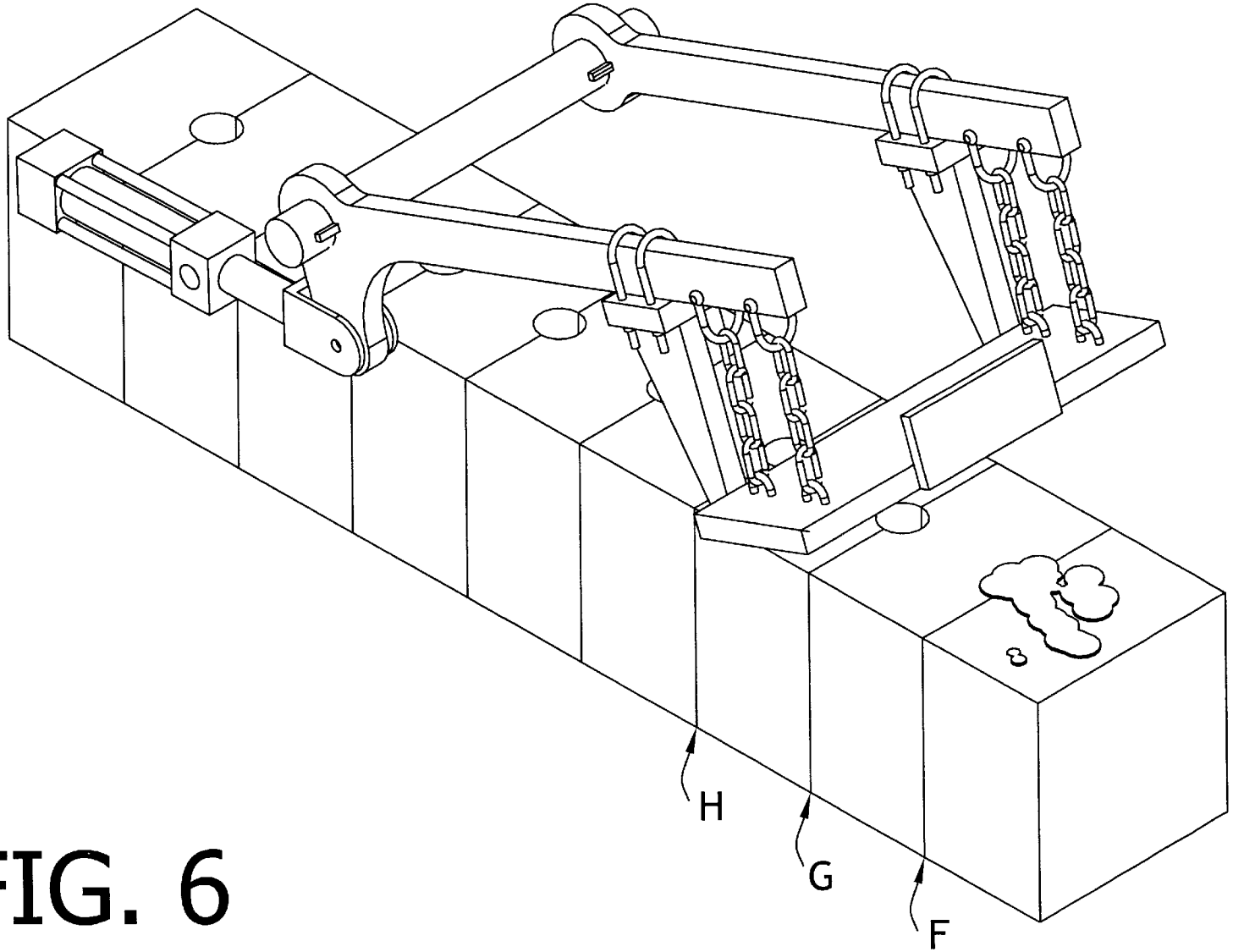
FIG. 6 is a perspective view of the mold riding shot blocker in a raised position.

The present invention provides an improved method for casting molten metal 22. As shown generally in FIGS. 4–6, the present invention provides a method for blocking the spillage of molten metal 22 between adjacent molds in a conveyable string of closely juxtaposed molds as the mold string is advanced in a stepwise cycle in a metal casting process. As shown in FIG. 6, the first step of the present invention is positioning a blocking bar 31 in an initial position above a mold string 11. This initial position is accomplished by raising the lift arms 32 and having the blocking bar 31 swing back until a portion of the blocking bar 31 abuts the forward surface of the stops 41. Next, the blocking bar 31 is lowered onto the top surface 13 of the mold string 11 into a blocking bar 31 rest position. In the rest position, the bottom surface of the blocking bar 31 is placed in conforming contact with a portion of the top surface 13 of the mold string 11 in a selective position wherein the blocking bar 31 covers at least one downsprue 16 extending from the top surface 13. The blocking bar 31 is placed on the mold string 11 when the mold string 11 is in a stationary position. The blocking bar 31 in a rest position is shown in FIG. 4. The next step in the present invention is indexing the conveyable mold string 11 with the blocking bar 31 riding on the mold string 11 in the aforementioned rest position during at least a portion of the stepwise advancing cycle. The stepwise cycle comprises the movement of the mold string 11 from a stationary first position to a stationary next position. The position of the blocking bar 31 during a segment of the indexing step is shown in FIG. 5. As is shown, the indexing step results in the movement of the blocking bar 31 away from the stops 41, which progressively eliminates slack from the chains 33. However, as long as there is slack remaining in the chains 33, the blocking bar will remain in a rest position on the top surface 13 of the mold string 11 as the mold string is advanced. The next step in the present invention is raising the blocking bar 31 away from the top surface 13 of the mold string 11 to uncover a downsprue 16. As the lift arms 32 are raised, the blocking bar 31 is lifted from the mold string 11 an allowed to swing freely below the lift arms 32 until it comes to rest against the stops 41. The preferred embodiment of the present invention in a raised position wherein the blocking bar 31 is resting against the stops 41 is shown in FIG. 6. The raising step may occur with the mold string 11 in a stationary position after the completion of the stepwise cycle, or it may occur as the mold string 11 is moving during the stepwise cycle. In the preferred embodiment, the raising step occurs while the mold string 11 is moving after three quarters of the stepwise cycle has been completed.

FIGS. 4–6 also show use of the present invention in relation to a casting process. Reference is made to three successive molds F, G, H that move along the conveyable mold string 11 from left to right as depicted on FIGS. 4–6. These molds are indicated with reference to the centrally located vertical parting line. As shown on FIG. 6, a mold string 11 is indexed to a stationary position having a first mold F aligned below a source of molten metal 22. Although not shown on FIG. 6, at this point in the casting process the first mold F has been indexed but not filled with molten metal. Next, a substantially solid object such as the blocking bar 31 is lowered onto a second mold G adjacent first mold F. This lowering step is performed with the mold string 11 in a stationary position. At the completion of this lowering step, the blocking bar 31 rests on the top surface 13 of the mold string 11 as shown in FIG. 5. In this rest position, the blocking bar 31 covers the downsprue of the second mold G to provide a molten metal barrier between the first and second mold. Next, with the mold string maintained in a stationary position, the first mold F is filled with a selective amount of molten metal. FIG. 5 shows an excess amount of molten metal on the top surface of the first mold F being present after molten metal has been poured into the first mold F.

After the first mold F has been filled with molten metal, the mold string 11 is indexed as shown in FIG. 6. The acceleration of the mold string from its initial position causes excess molten metal on the top surface of first mold F to travel across the top surface 13 of the mold string 11 toward the downsprue of the second mold G. If the blocking bar were not covering the downsprue of the second mold G, it is likely at least a portion of the molten metal on the top surface 13 would enter the downsprue of the second mold G. However, with the blocking bar 31 of the present invention, a barrier is maintained during the indexing step as the conveyable mold string 11 moves along the casting process to prevent the premature introduction of molten metal into the second mold G. As shown in FIG. 6 the blocking bar 31 is lifted to uncover the downsprue of the second mold G. The advancing step is complete when the second mold G is aligned below the source of molten metal 22. The blocking bar 31 is lifted either with the mold string 11 in a stationary position after it has completed its advancing step, or as the mold string 11 is moving prior to the completion of the advancing step. After completion of the advancing step, with the second mold G positioned below the source of molten metal, the lift arms 32 are lowered to place the blocking bar 31 in a rest position on the mold string 11 covering the downsprue of a third mold H adjacent to the second mold G. The second mold G is then filled with molten metal 22 and the foregoing steps are sequentially repeated as the mold string 11 during the casting process.

Figure 7:
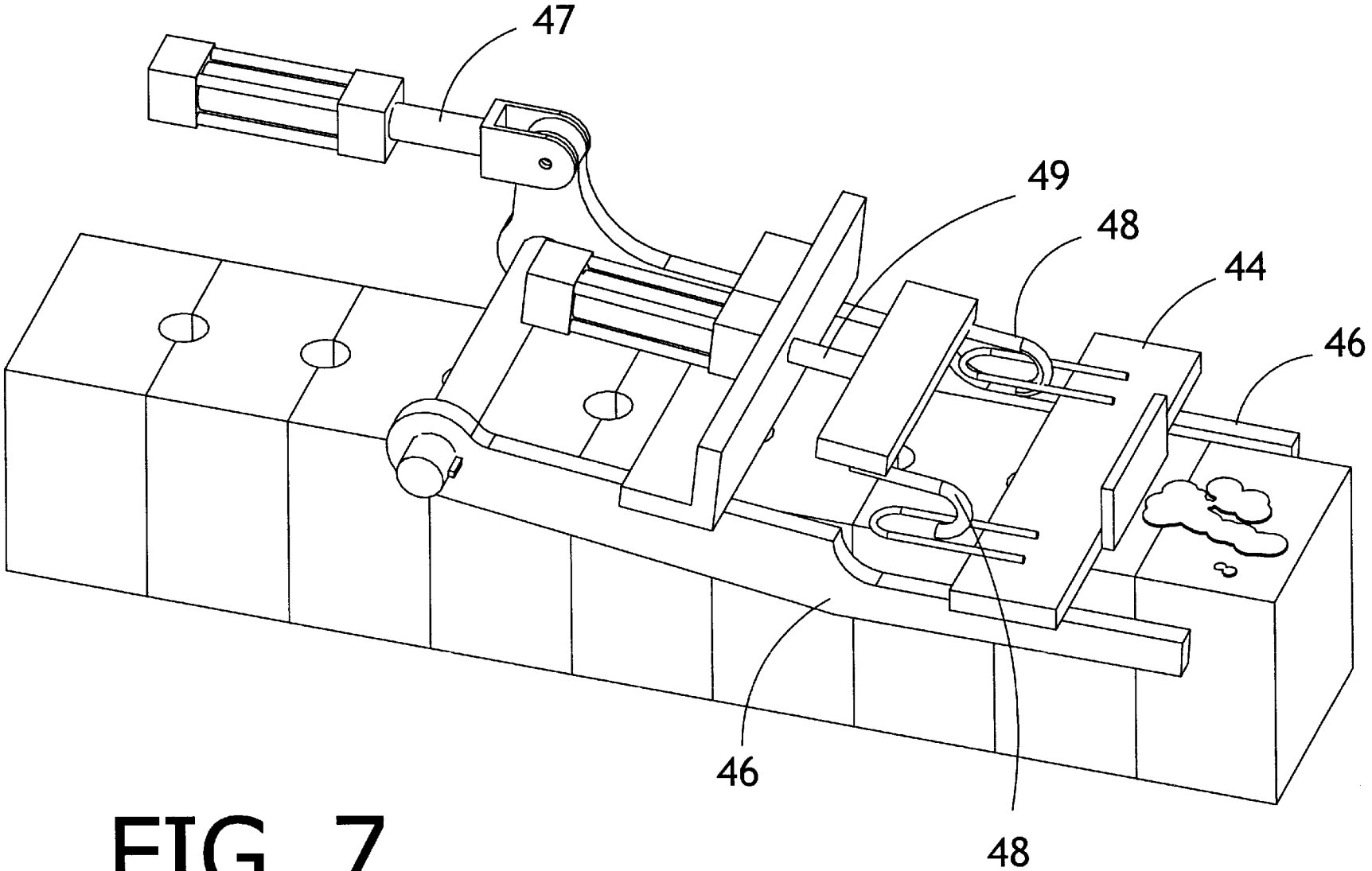
FIG. 7 is a perspective view of a second embodiment of the present invention.

A second embodiment of the present invention is shown in FIG. 7. This embodiment differs from the preferred embodiment primarily in the means utilized to raise and lower the blocking bar 44 from a mold string 11. For instance, unlike the preferred embodiment, the lift arms 46 are raised from the surface of the mold string by the rearward linear movement of the control rod 47 away from the blocking bar 44, instead of the forward movement of the control rod 38 as in the preferred embodiment. Further, in the second embodiment, the blocking bar 44 is part of an assembly that is separate from the lift arms 46. Thus, in the second embodiment the blocking bar 44 rides freely atop the surface of the mold string 11 until it is engaged by a pair of hooks 48 fixedly attached to the lift arm assembly. When the lift arms 46 of the second embodiment are raised, the hooks 48 are moved rearward by a pull rod 49, causing the blocking bar 44 to move rearward to an initial position wherein the lift arms 46 are lowered to place the blocking bar in a rest position on the top surface of a mold string 11. The pull rod 49 is then moved forward to a selective position for subsequent engagement with the blocking bar assembly. Unlike the preferred embodiment of the present invention, the second embodiment requires mechanical forward and rearward indexing of a pull rod 49.

Although the present invention may be manually operated, it is contemplated that the present invention may be utilized with a control means to automate the raising and lowering of the mold riding shot blocker in relation to the indexing of the mold string 11. This coordination can be accomplished by control means that are well known in the art, including but not limited to the use of conventional and electrical circuitry, switch mechanisms, and other conventional control structures such as micro-processors to automate operation of the present invention. The control means for the present invention may be integrated with control systems for automated casting production processes that are well known in the art.

What I claim is:

1. An apparatus for preventing the premature introduction of molten metal into a mold cavity formed by a conveyable string of molds as said mold string is advanced stepwise along a conveying system in a metal casting process, wherein said molds define a substantially continuous top surface, a series of mold cavities, and a series of downsprues extending from said mold cavities to said top surface, said apparatus comprising in combination:

a. a substantially solid blocking bar; and b. means for positioning said blocking bar on the top surface of said mold string to cover at least one of said series of downsprues during concomitant motion of said mold string and said blocking bar.

2. An apparatus as described in claim 1 wherein said means for positioning comprises in combination:

a. a pair of lifting arms positioned above said blocking bar, said arms having a proximal end and a distal end;

b. a plurality of inextensible flexible links connecting said blocking bar to said distal ends of said lift arms, said links being of predetermined lengths such that said blocking bar hangs freely below said lift arms when said lift arms are in a raised position and said blocking bar rests on said top surface of said mold string when said lift arms are in a lowered position;

c. a connecting rod having a longitudinal axis of rotation fixedly attached to the proximal ends of said lift arms; and d. means for pivoting said connecting rod about said longitudinal axis to raise said lift arms to remove said blocking bar from said mold string and to lower said lift arms to position said blocking bar on said mold string.

3. An apparatus as described in claim 2 wherein said blocking bar is a rectangular bar having a substantially flat bottom, a substantially flat upper surface opposite said bottom surface, a substantially a flat forward surface near the proximal end of said lift arms, and a substantially flat rear surface opposite said forward surface.

4. An apparatus as described in claim 2 wherein said links are selected from a group consisting of chains and wires.

5. An apparatus as described in claim 3 further comprising a substantially solid bar shield fixedly attached to said forward surface of said blocking bar.

6. An apparatus as described in claim 3 further comprising a pair of stops extending below said lift arms and fixedly attached to said lift arms between said rod and said blocking bar, said stops having a flat forward surface facing the distal end of said lift arms such that when said lift arms are in a raised position said blocking bar hangs from said lifts arms with at least a portion of said rear surface of said blocking bar in conforming contact with at least a portion of said forward surface of said stops.

7. An apparatus as described in claim 6 wherein said lift arms are substantially perpendicular to said stops and the distance between said lift arms is greater than the width of said mold string such that when said lift arms are in a lowered position said stops are on each side of said mold string with at least a portion of said stops extending below a plane defined by said substantially continuous top surface of said mold string.

8. An apparatus as described in claim 7 wherein said means for pivoting said connecting rod comprises in combination:

a. means for rotatably mounting said connecting rod above said mold string;

b. an extension portion of one of said pair of lift arms extending below said connecting rod at the proximal end of said one lift arm; and c. a straight position control rod pivotally mounted at its forward end to said extension portion of said lift arm such that the linear movement of said position rod causes the concomitant rotation of said lift arms and said connecting rod about said longitudinal axis.

9. A method for blocking the spillage of molten metal between adjacent molds in a conveyable string of closely juxtaposed molds as said mold string is advanced in a stepwise cycle in a metal casting process wherein each said mold defines a top mold surface, a casting cavity, and at least one mold inlet extending from said casting cavity to said top mold surface, said method comprises the steps of:

a. positioning a blocking bar having a substantially flat bottom surface in an initial position above said mold string;

b. lowering said blocking bar into a protective position on a top surface of a first mold in a stationary first position wherein at least a portion of said bottom surface of said blocking bar is in conforming contact with at least a portion of said top surface of said first mold and said blocking bar covers at least one said mold inlet of said first mold;

c. indexing said conveyable mold string with said blocking bar riding on said mold string in said protective position through at least a portion of a stepwise cycle comprising the movement of said conveyable mold string from a stationary first position to a stationary second position; and, d. raising said blocking bar from said top surface of said first mold to uncover said mold inlet of said first mold.

10. The method for blocking the spillage of molten metal described in claim 9 further comprising after said raising step the step of returning said blocking bar to said initial position.

11. The method for blocking the spillage of molten metal described in claim 10 further comprising after said returning step the step of placing said blocking bar onto the top surface of a second mold adjacent said first mold.

12. The method for blocking the spillage of molten metal described in claim 9 wherein said raising step occurs during the motion of said mold string between said first position to said second position after completion of at least three-quarters of said stepwise cycle.

13. The method for blocking the spillage of molten metal described in claim 9 wherein said raising step occurs after said mold string has completed said stepwise cycle.

14. An improved method of casting molten metal comprising the steps of:

a. aligning a first mold defining a first casting cavity and a first downsprue below a source of molten metal having an effluent outlet for directing molten metal into said first downsprue, b. lowering a substantially solid object onto a second mold defining a second casting cavity and a second downsprue to cover said second downsprue and provide a molten metal barrier between said first mold and said second downsprue, said second mold being adjacent to said first mold in a conveyable string of molds, c. pouring molten metal from said effluent outlet into said first downsprue and said first cavity;

d. indexing said conveyable string of molds after completion of said pouring step by moving said mold string to a new operating position wherein said second mold is positioned below said effluent outlet;

e. raising said solid object from said second mold to uncover said second downsprue after completion of at least a portion of said indexing step;

f. placing said solid object onto a third mold defining a third casting cavity and a third downsprue to cover said third downsprue and provide a molten metal barrier between said second mold and said third downsprue, said third mold being adjacent to said second mold in said conveyable string of molds; and g. pouring molten metal from said effluent outlet into said second downsprue and second cavity.

15. An improved method for casting molten metal as described in claim 14 wherein said solid object is raised from said second mold after completion of said indexing step.

16. An improved method for casting molten metal as described in claim 14 wherein said conveyable mold string is moved during said indexing step a distance approximately equal to the length of said molds and wherein said solid object is raised from said second mold before the completion of said indexing step and after said mold string is moved a distance of at least about three-quarters of the length of said molds.

17. An improved method for casting molten metal as described in claim 14 wherein said raising step comprises pivoting a connecting rod having a longitudinal axis about said axis wherein said connecting rod is positioned in a generally horizontal position above said conveyable mold string perpendicular to the direction of indexing said mold string, said rod being fixedly attached to proximal ends of a pair of lift arms extending above said mold string and said solid object with said lift arms attached at said distal ends to said solid object by a plurality of inextensible flexible links, said pivoting resulting in the concomitant upward movement of said distal ends of said lift arms away from said second mold wherein said upward movement removes said solid object from said second mold and said solid object swings toward the proximal ends of said lift arms as it is suspended below said lift arms by said flexible links until said solid object comes into conforming contact with a pair of stops fixedly attached to said lift arms.

18. An improved method for casting molten metal as described in claim 14 wherein said lowering step comprises pivoting said rod about said axis with said solid object initially in conforming contact with said stops, said pivoting resulting in the concomitant downward movement of said distal ends of said lift arms toward said second mold to place said solid object on said second mold and to create slack in said flexible links.

19. An improved casting machine for receiving molten metal from an effluent outlet, comprising:

a conveyable series of molds having a substantially continuous top surface, each said mold defining a casting cavity and a downsprue providing communication between said top surface and casting cavity;

a blocking bar having a bottom surface and a top surface; and means for raising and lowering said blocking bar from the top surface of said mold string to selectively cover and uncover at least one downsprue extending from said top surface of said series of molds, wherein said means for raising and lowering said blocking bar comprises in combination:

a. a pair of lift arms having a proximal end and a distal end positioned above said blocking bar and on each side of said series of molds;

b. a plurality of inextensible flexible links having a predetermined length connecting said top surface of said blocking bar to said distal end of said lift arms;

c. a connecting rod having two ends and a longitudinal axis fixedly attached at said ends to the proximal ends of said lift arms substantially perpendicular to said lift arms;

d. a pair of stops fixedly attached to and extending below said lift arms;

e. means for rotatably mounting said connecting rod; and f. means for selectively rotating said connecting rod between a raised position wherein said blocking bar hangs from said lift arms above said top surface of said series of molds and a portion of the surface of said blocking bar abuts a portion of the surface of said stops and a lowered position wherein at least a portion of said bottom surface of said blocking bar abuts at least a portion of said top surface of said series of molds to cover and uncover at least one downsprue extending from said top surface.

20. An improved casting machine as described in claim 19 wherein the predetermined length of said flexible links is sufficient to allow said blocking bar to ride unimpeded on said conveyable series of molds covering said downsprue for a predetermined distance as said conveyable series of molds is indexed in a metal casting process.

21. An improved casting machine as described in claim 20 wherein said predetermined distance said blocking bar rides on said conveyable series of molds is at least three quarters of the approximate distance between said successive downsprues in said series of molds.

* * * * *